United States Patent [19]

Kohler et al.

[11] 4,164,905

[45] Aug. 21, 1979

[54] LUMPED NEUTRALIZATION COIL ARRANGEMENT FOR INDUCTANCE FUZE

[75] Inventors: Hans W. Kohler, Sarasota, Fla.; Helmut Sommer, Bethesda, Md.

[73] Assignee: The United States of America as represented by the Secretary of the Army, Washington, D.C.

[21] Appl. No.: 211,140

[22] Filed: Dec. 22, 1971

[51] Int. Cl.[2] ..... F42C 13/08; F42C 19/00

[52] U.S. Cl. ..... 102/212

[58] Field of Search ..... 102/7, 8, 16, 18, 19.2, 102/70 R, 70 S, 70.2 R, 70.2 P, 70.2 A; 324/6, 41; 244/3.14

[56] References Cited

U.S. PATENT DOCUMENTS

| | | | |
|---|---|---|---|
| 2,237,254 | 4/1941 | Broekhuysen | 324/41 |
| 2,514,359 | 7/1950 | Allison | 102/70.2 R |
| 3,108,220 | 10/1963 | Ruddock | 324/6 |
| 3,111,901 | 11/1963 | Dodson et al. | 102/70.2 R |

*Primary Examiner*—Harvey E. Behrend
*Assistant Examiner*—Thomas H. Webb
*Attorney, Agent, or Firm*—Nathan Edelberg; Robert P. Gibson; Saul Elbaum

[57] ABSTRACT

An inductance fuze for armor defeating shells and missiles that utilizes lumped neutralization, i.e., cancellation of an AC voltage, induced by a primary coil in a sensing coil under free-space conditions, by an equal and opposite voltage. The lumped neutralizing voltage is obtained from a neutralizing coil that is also coupled to the primary. Adjustment of neutralization is made by translating axially either the sensing coil, the neutralizing coil or both relative to the primary coil. The physical configurations of the coils can be adjusted to be accommodated within the fuze ogive as long as a certain relationship involving the number of turns and the flux amplitudes is maintained.

5 Claims, 9 Drawing Figures

LUMPED NEUTRALIZATION COIL ARRANGEMENT FOR INDUCTANCE FUZE

RIGHTS OF GOVERNMENT

The invention described herein may be manufactured, used, and licensed by or for the United States Government for governmental purposes without the payment to us of any royalty thereon.

BACKGROUND OF THE INVENTION

1. Field of the Invention

This invention relates to inductive proximity sensors and, more particularly, to a lumped neutralization inductive proximity sensor for use in ordnance fuzes.

2. Description of the Prior Art

An inductive proximity sensor for armor defeating shell fuzes must meet requirements much more severe than those of conventional metal and mine detectors. No adjustments of any kind may be made during its use. Set back and centrifugal forces must not adversely effect the electrical characteristics of the device. The space within the ogive of the round limits the size and configuration of the primary and sensing coils. In prior art systems, neutralizing voltages are derived from a potentiometer arrangement across the primary coil. This involves the use of sliding contacts and/or electrical components such as resistors and capacitors which may be adversely effected under field conditions where shock, vibration, temperature extremes occur. In another prior art arrangement involving turn-by-turn neutralization described in U.S. Pat. No. 3,588,687, sensing and neutralizing coils must physically conform to the flux lines created by a primary coil, thereby creating additional geometrical restrictions within the fuze ogive. Accordingly, it would be extremely advantageous in a neutralization system if sliding contacts and electrical components could be avoided, and adjustments to obtain the null could be easily obtained, while at the same time having the ability to accommodate such a system within the space limitations of the fuze ogive.

Accordingly, it is an object of the present invention to provide a novel sensing coil arrangement for an inductance fuze that utilizes lumped neutralization wherein no sliding contacts or electrical components are necessary for adjustment of the coils.

A further object of the present invention is to provide a coil arrangement for an inductance fuze in which adjustments of neutralization are made by axial translations of the sensing coil, the neutralizing coil or both relative to the primary coil. An additional object is to provide a coil arrangement in lumped neutralization for an inductance proximity sensor in which the coils are easily configured to adapt to the space limitations of the ogive by maintaining a particular relationship involving the number of turns and the flux linkages in each coil.

Yet another object of the invention is to provide a sensing coil arrangement which is simple to design, inexpensive to construct and is easily incorporated into an existing fuze design.

SUMMARY OF THE INVENTION

Briefly, in accordance with the invention, the inductive proximity sensor comprises a primary coil, a secondary coil and a neutralizing coil. A detector is connected to the neutralizing and sensing coils to detect changes in the null conditions when the fuze approaches the target. Adjustment of neutralization is made by translating axially either the sensing coil, the neutralizing coil, or both relative to the primary coil. By maintaining an equal turns times flux constant in the neutralizing and sensing coils, many ogive configurations can be accommodated by the system of the present invention.

BRIEF DESCRIPTION OF THE DRAWINGS

The specific nature of the invention as well as other objects, aspects, uses, and advantages thereof will clearly appear from the following description and from the accompanying drawings in which.

DESCRIPTION OF THE PREFERRED EMBODIMENTS

Lumped neutralization means cancellation of the AC voltage induced by the primary coil in the sensing coil under free space conditions, by an equal and opposite voltage. This method of neutralization is distinct from turn by turn neutralization described in U.S. Pat. No. 3,588,687. The lumped neutralizing voltage is obtained preferably from a second or neutralizing coil also coupled to the primary. Adjustment of neutralization is made by translating axially either the sensing coil, the neutralizing coil or both relative to the primary. This has the advantage that no sliding contacts are involved as would be the case if the neutralizing voltage were derived from a potentiometer arrangement across the primary. Various configurations of primary sensing and neutralizing coils useful in ordnance applications are shown in FIGS. 1–8.

Figure 1:
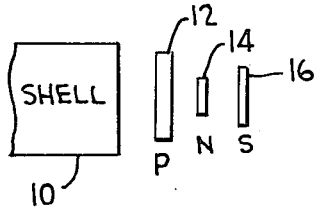
FIG. 1 is a simplified diagram of one possible embodiment of the coil arrangement according to the present invention.
Figure 2:
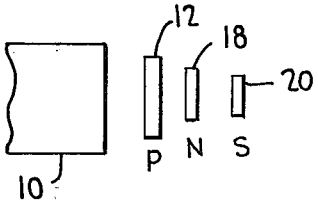
FIG. 2 is another embodiment illustrating a possible configuration of the coils according to the present invention.
Figure 3:
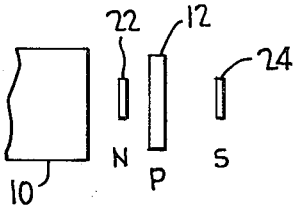
FIG. 3 is another embodiment of a possible configuration of the coils according to the present invention.
Figure 9:
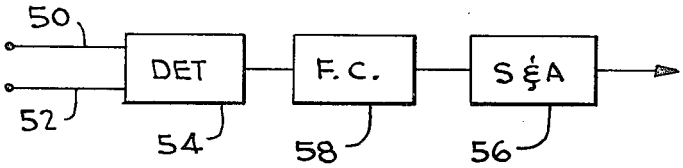
FIG. 9 illustrates a typical circuit arrangement in accordance with the teachings of the present invention.

In FIGS. 1–3 all the coils are circular and compact, i.e., the winding cross-section, circular, square, or rectangular, has dimensions small compared to the coil diameter. Under these conditions, all the turns of the coil are linked essentially with the same flux, and we have neutralization when $$N_1\phi_1 = N_2\phi_2$$

where $N_1$ and $N_2$ are the number of turns of the sensing and neutralizing coils, respectively, and $\phi_1$ and $\phi_2$ are the amplitudes of fluxes linking the coils. In FIG. 1 the arrangement comprises a shell 10, a primary coil 12, a neutralizing coil 14, and a sensing coil 16. In FIG. 1 the mean diameters of sensing coil 16 and neutralizing coil 14 are such that the coils are centered on a flux tube surface. Thus, $\phi_1$ equals $\phi_2$ and $N_1$ equals $N_2$. This arrangement works well except that it is not convenient to accommodate the relatively large sensing coil near the tip of the ogive of the fuze. To remedy this, in FIG. 2 is illustrated another arrangement wherein the diameter of sensing coil 20 is reduced while at the same time the number of turns is increased such that the above equation holds. In FIG. 9 is illustrated a functional block diagram of a detector 54, a safety and arming device 56, and a firing circuit 58 which are connected to neutralizing coil 18 and sensing coil 20 via lines 52 and 50 respectively. Firing circuit 58 is triggered by the output signal of detector 54 and will initiate operation of a fuze explosive. A safety and arming device 56 is normally connected in such fuzes between firing circuit 58 and the rest of the explosive train to prevent accidental firing.

From the point of view of sensitivity, it is advantageous to have the sensing and neutralizing coils as far apart as possible. Such a configuration is illustrated in FIG. 3 wherein neutralizing coil 22 and sensing coil 24 are located on opposite sides of primary coil 12.

Figure 4:
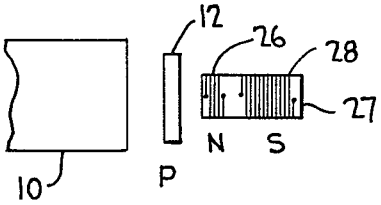
FIG. 4 is an illustration of a distributed coil arrangement according to the teachings of the present invention.
Figure 5:
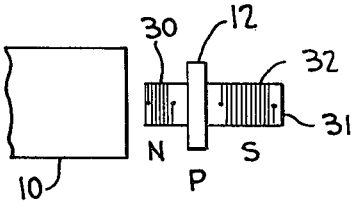
FIG. 5 is another embodiment of a distributed coil arrangement according to the present invention.

In artillery applications of the proximity sensor, setback and spin forces acting on the coils are quite large and may break the wire. The probability of wire breakage is reduced if the sensing and neutralizing coils are distributed instead of compact. By distributed is meant a single layer coil as is shown in FIGS. 4 and 5, which are the distributed coil equivalents of FIGS. 2 and 3. In FIG. 4 neutralizing coil 26 and sensing coil 28 are shown distributed on a coil form 27 on the same side of primary coil 12, whereas in FIG. 5 neutralizing coil 30 and sensing coil 32 are shown distributed on a coil form 31 on opposite sides of primary 12.

Figure 6:
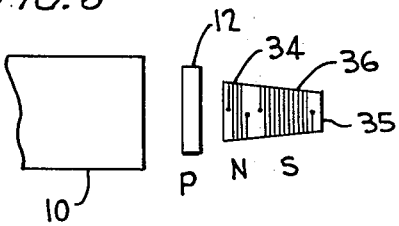
FIG. 6 is still another embodiment showing distributed sensing and neutralization coils in accordance with the teachings of the present invention.
Figure 7:
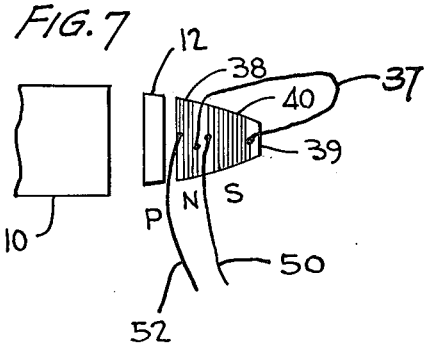
FIG. 7 illustrates another embodiment of distributed sensing and neutralizing coils.

Other possible configurations of distributed sensing and neutralizing coils in accordance with the teachings of the present invention are shown in FIGS. 6 and 7. In FIG. 6, the coil form 35 is in the shape of a truncated cone and has located thereon neutralizing coil 34 and sensing coil 36, whereas in FIG. 7 coil form 39 is in the shape of a curved cone and has neutralizing coil 38 and sensing coil 40 located thereon. FIG. 7 also illustrates the series-opposing connection 37 between neutralizing coil 38 and sensing coil 40. By virtue of the foregoing connection and the equal turns/flux product in each coil, the voltages generated in each coil 38 and 40 will buck-out in free space conditions. When shell 10 approaches the target, the null condition is disturbed and the resultant voltage is fed via lines 52 and 50 to detector 54, as aforedescribed. It is easily seen that many possible configurations can be accommodated within various shapes of fuze ogives in accordance with the teachings of the present invention.

Figure 8:
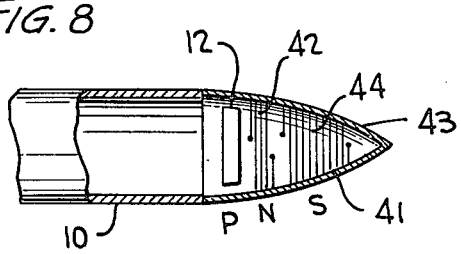
FIG. 8 illustrates a printed circuit arrangement in accordance with the teachings of the present invention.

For highest reliability in artillery applications, the coils can be made of printed (etched) circuits instead of single layer wire as aforedescribed. To increase the number of turns in such a configuration, a printed winding can be put on both the outside and inside of the substrate and connected in series aiding. Another possible configuration of etched circuits is shown in FIG. 8, wherein neutralizing coil 42 and sensing coil 44 are printed directly on the inside surface of the ogive 43 of shell 10. In this manner, space limitations are minimized and reliability is increased. Clearly, it is also possible to use the printed circuit technique for the primary coil.

We wish it to be understood that we do not desire to be limited to the exact details of construction shown and described, for obvious modifications will occur to a person skilled in the art.

We claim as our invention:

1. An inductance proximity fuze comprising:

(a) A primary coil;

(b) Means for applying current to said primary coil to establish a magnetic field having an infinite number of field lines;

(c) A passive secondary coil having a first number of turns and disposed relative to said primary coil such that said first number of turns are traversed by a first portion of said field lines;

(d) A passive neutralizing coil having a second number of turns connected in series opposition to said secondary coil and disposed relative to said primary coil such that the second number of turns are traversed by a second portion of said field lines and such that under free space conditions the product of said first portion of field lines and said first number of turns is approximately equal to the product of said second portion of field lines and said second number of turns; said primary, secondary, and neutralizing coils being wound symmetrically about a common axis which coincides with the longitudinal axis of said proximity fuze;

(e) Means connected to said secondary coil and said neutralizing coil for detecting any voltage differences induced therein by magnetic field disturbance of said free space magnetic conditions; and (f) Means for initiating operation of a fuze in response to a predetermined voltage difference existent across said secondary coil and said neutralizing coil.

2. The inductance fuze according to claim 1 wherein said primary coil is located in mutually spaced relation between said secondary coil and said neutralizing coil.

3. The inductance fuze according to claim 1 wherein said neutralizing coil is located between the positions of said primary coil and said secondary coil on said axis.

4. The inductance fuze according to claim 3 wherein said neutralizing coil and said secondary coil are spaced along a core in an ogive configuration.

5. The inductance fuze according to claim 3 wherein said neutralizing coil and secondary coil are etched on the inside surface of said fuze ogive.

* * * * *